US011189122B2

(12) United States Patent
Cost

(10) Patent No.: US 11,189,122 B2
(45) Date of Patent: Nov. 30, 2021

(54) OPEN BANKNOTE PATH SYSTEM

(71) Applicant: Crane Payment Innovations, Inc., Malvern, PA (US)

(72) Inventor: Evan J. Cost, Malvern, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 13 days.

(21) Appl. No.: 16/648,191

(22) PCT Filed: Dec. 7, 2018

(86) PCT No.: PCT/US2018/064486
§ 371 (c)(1),
(2) Date: Mar. 17, 2020

(87) PCT Pub. No.: WO2019/113450
PCT Pub. Date: Jun. 13, 2019

(65) Prior Publication Data

US 2020/0286322 A1 Sep. 10, 2020

Related U.S. Application Data

(60) Provisional application No. 62/595,936, filed on Dec. 7, 2017.

(51) Int. Cl.

| | |
|---|---|
| ***G07D 11/16*** | (2019.01) |
| ***G07D 11/40*** | (2019.01) |
| ***G07F 7/04*** | (2006.01) |

(52) U.S. Cl.
CPC ..... *G07D 11/16* (2019.01); *G07D 11/40* (2019.01); *G07F 7/04* (2013.01)

(58) Field of Classification Search
CPC ..... B65H 5/06; B65H 5/062; B65H 5/064; B65H 5/066; B65H 5/068; B65H 9/106;
(Continued)

(56) References Cited

U.S. PATENT DOCUMENTS 5,377,805 A * 1/1995 Ono ..... G07F 7/04 194/206
5,450,937 A * 9/1995 Ono ..... G07F 7/04 194/203

(Continued)

FOREIGN PATENT DOCUMENTS

JP 2009-101171 A 5/2009

OTHER PUBLICATIONS

ISA/US, "International Search Report and Written Opinion of the International Searching Authority," International Application No. PCT/US2018/064486, dated Feb. 11, 2019, 10 pages.

*Primary Examiner* — Thien M Le
*Assistant Examiner* — April A Taylor

(57) ABSTRACT

An open banknote system comprises a first banknote path plate and a second banknote path plate coupled to a frame, wherein the first banknote path plate and the second banknote path plate are disposed a distance apart, a banknote path disposed in a space between the first banknote path plate and the second banknote path plate, wherein each of a first side and a second side of the banknote path open to an area wider than a central portion of the banknote path, and a plurality of rollers each coupled to one of the first banknote path plate and the second banknote path plate, wherein each one of the plurality of rollers forms a banknote pinch point with another one of the plurality of rollers.

22 Claims, 8 Drawing Sheets

(58) Field of Classification Search
CPC . B65H 2701/1912; G07F 7/04; G07F 19/202; G07F 19/205; G07D 11/00; G07D 11/0087; G07D 11/009; G07D 11/0096; G07D 11/10; G07D 11/12; G07D 11/13; G07D 11/14; G07D 11/16; G07D 11/165; G07D 13/00; G07D 2211/00
See application file for complete search history.

(56) References Cited

U.S. PATENT DOCUMENTS

| | | | | |
|---|---|---|---|---|
| 5,494,144 | A * | 2/1996 | Izawa | G07F 7/04 194/203 |
| 2008/0047802 | A1 * | 2/2008 | Nireki | G07D 11/14 194/302 |
| 2013/0154181 | A1 | 6/2013 | Doan | |
| 2015/0298929 | A1 | 10/2015 | Hiratsuka et al. | |

* cited by examiner

OPEN BANKNOTE PATH SYSTEM

CROSS-REFERENCE TO RELATED APPLICATIONS

This application is a 371 National Stage of International Application No. PCT/US2018/064486, filed Dec. 7, 2018, which claims the benefit of Provisional Application No. 62/595,936, filed Dec. 7, 2017, the disclosures of which are herein incorporated by reference in their entirety.

TECHNICAL FIELD

This disclosure is generally directed to automated payment systems. More specifically, this disclosure is directed to an open banknote path system.

SUMMARY

This disclosure provides an open banknote path system. The system comprises a first banknote path plate and a second banknote path plate coupled to a frame, wherein the first banknote path plate and the second banknote path plate are disposed a distance apart, a banknote path disposed in a space between the first banknote path plate and the second banknote path plate, wherein each of a first side and a second side of the banknote path open to an area wider than a central portion of the banknote path, and a plurality of rollers each coupled to one of the first banknote path plate and the second banknote path plate, wherein each one of the plurality of rollers forms a banknote pinch point with another one of the plurality of rollers.

This disclosure provides a currency handling apparatus. The currency handling apparatus comprises a chassis, a banknote validator coupled to the chassis, a first banknote path plate and a second banknote path plate coupled to the chassis, wherein the first banknote path plate and the second banknote path plate are disposed a distance apart, a banknote path disposed in a space between the first banknote path plate and the second banknote path plate, wherein each of a first side and a second side of the banknote path open to an area wider than a central portion of the banknote path, and a plurality of rollers each coupled to one of the first banknote path plate and the second banknote path plate, wherein each one of the plurality of rollers forms a banknote pinch point with another one of the plurality of rollers.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1A through 3D, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably open banknote path system.

As used throughout this specification, the terms currency denomination, denomination of currency, valuable document, currency bill, bill, banknote, note, bank check, paper money, paper currency, and cash may be used interchangeably herein to refer to a type of a negotiable instrument or any other writing that evidences a right to the payment of a monetary obligation, typically issued by a central banking authority.

Figure 1A:
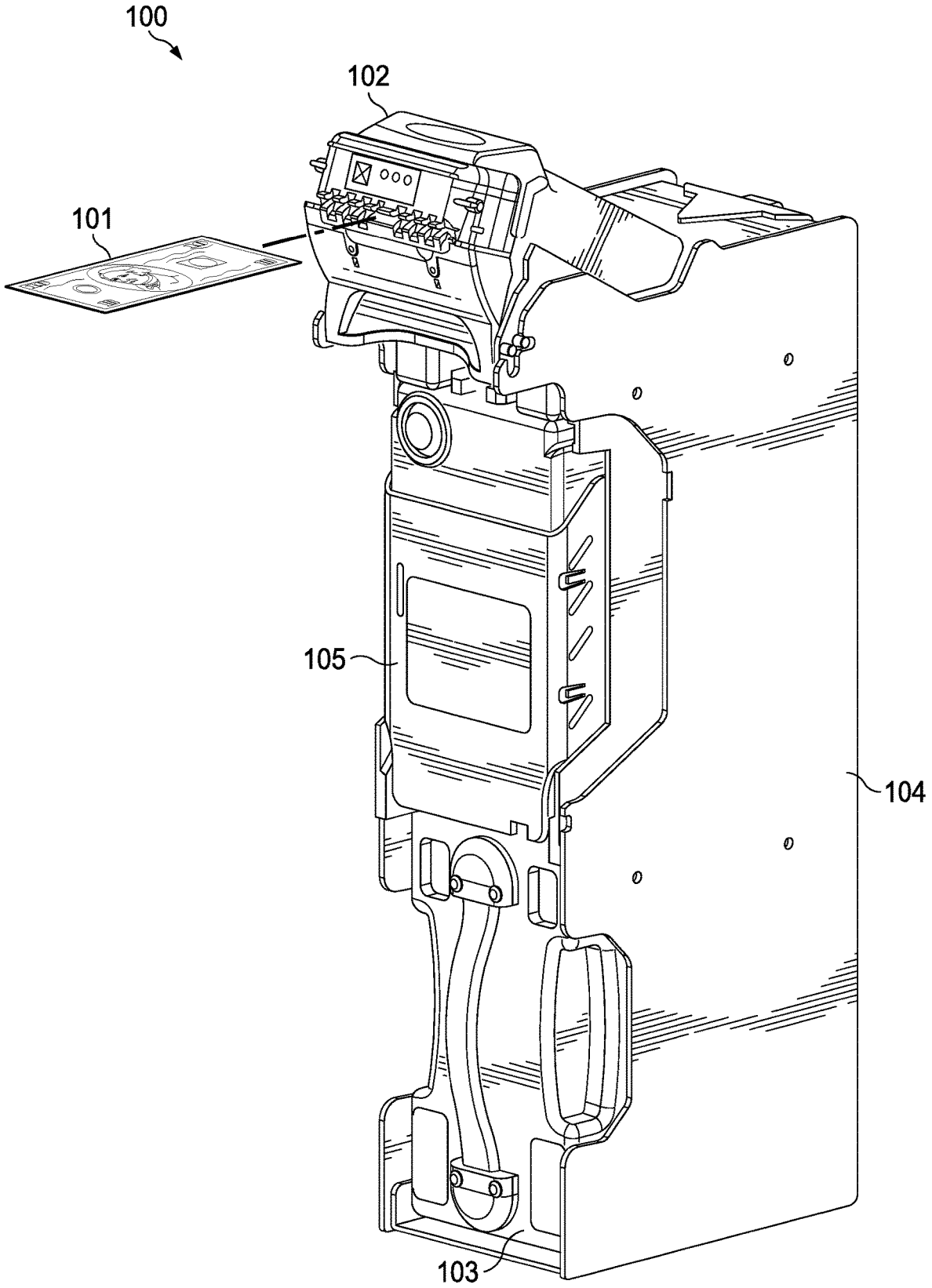
FIG. 1A illustrates an example of a currency handling apparatus in accordance with various embodiments of the present disclosure.
Figure 1B:
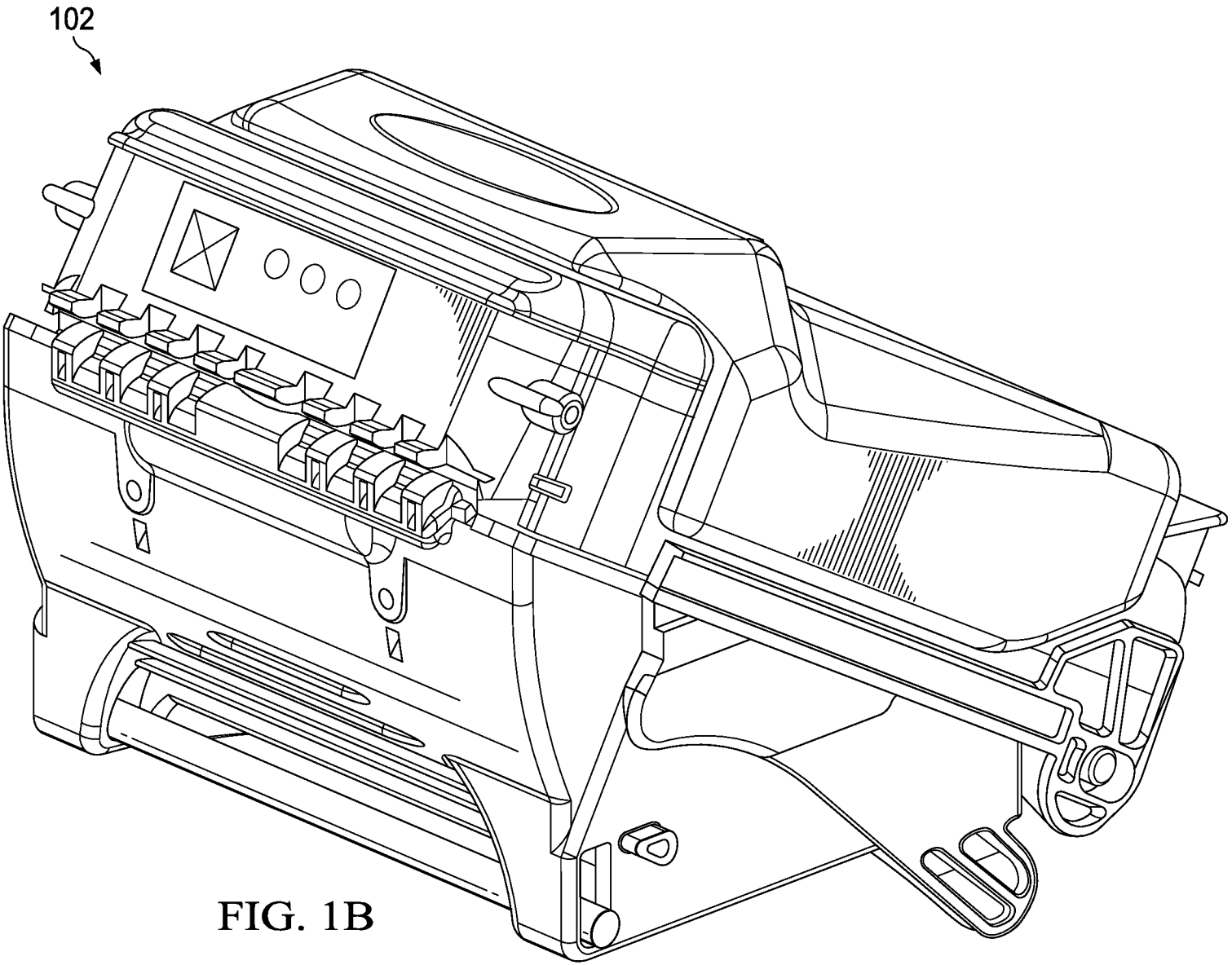
FIG. 1B illustrates an example of a note validator in accordance with various embodiments of the present disclosure.

FIGS. 1A and 1B illustrate examples of a currency handling apparatus 100 and note validator 102 according to an embodiment of this disclosure. Currency handling apparatuses and note validators come in a wide variety of configurations, and FIGS. 1A and 1B do not limit the scope of this disclosure to any particular implementation of a currency handling apparatus.

The currency handling apparatus 100 includes the note validator 102, a removable storage unit 103, and a chassis 104. In some implementations, note validator 102 is removably coupled to chassis 104. Note validator 102 can be configured to receive a note 101 and transport the currency item past a sensing component to determine the type and validity of note 101. In one or more embodiments, a banknote recycler 105 may also be included. In some implementations, removable storage unit 103 includes a transportation device for transporting note 101 to and/or from the removable storage unit 103.

Although FIGS. 1A and 1B illustrate one example of a currency handling apparatus 100 and note validator 102, various changes may be made to FIGS. 1A and 1B. For example, the currency handling apparatus 100 could be used in automatic ticket seller machines, automatic teller machines, vending machines and other kiosks. Also, there could be more than one removable storage unit 103.

Figure 2A:
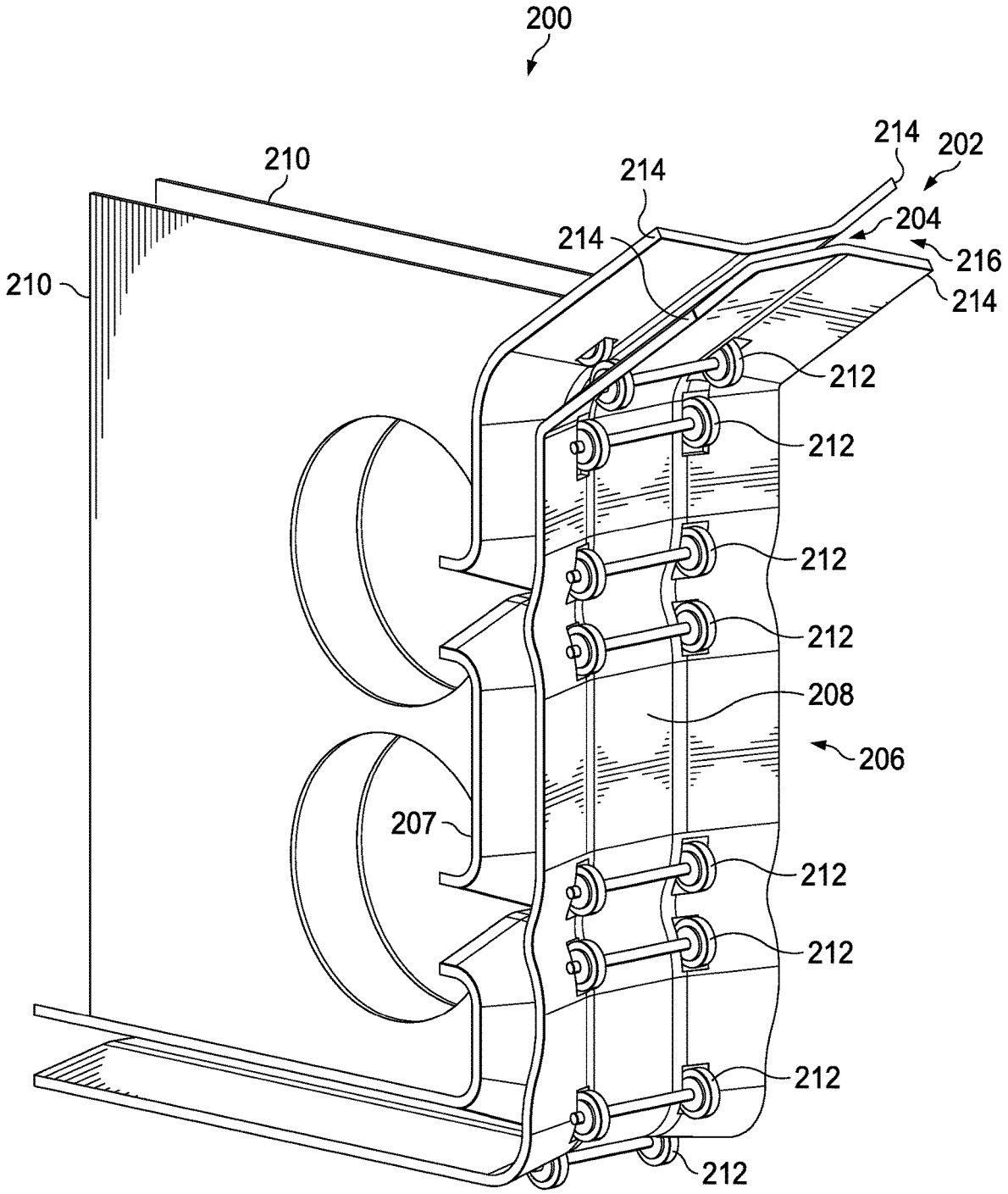
FIG. 2A illustrates a front perspective view of an open banknote path system in accordance with various embodiments of the present disclosure.
Figure 2B:
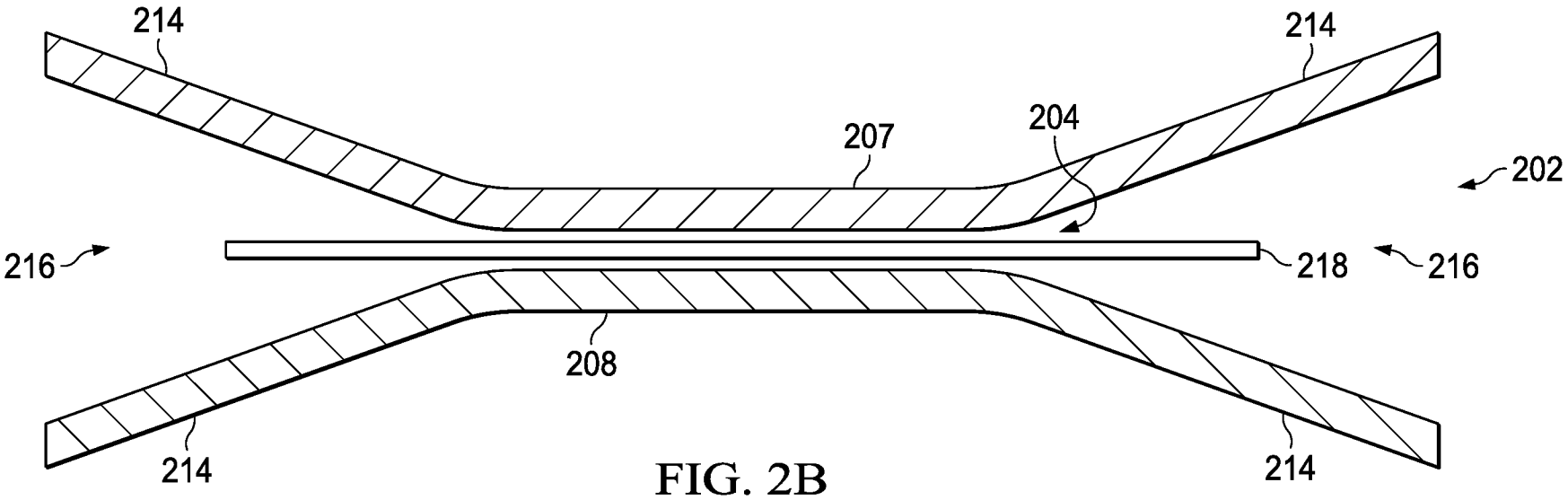
FIG. 2B illustrates a cross-sectional view of a banknote path of an open banknote path system in accordance with various embodiments of the present disclosure.
Figure 2C:
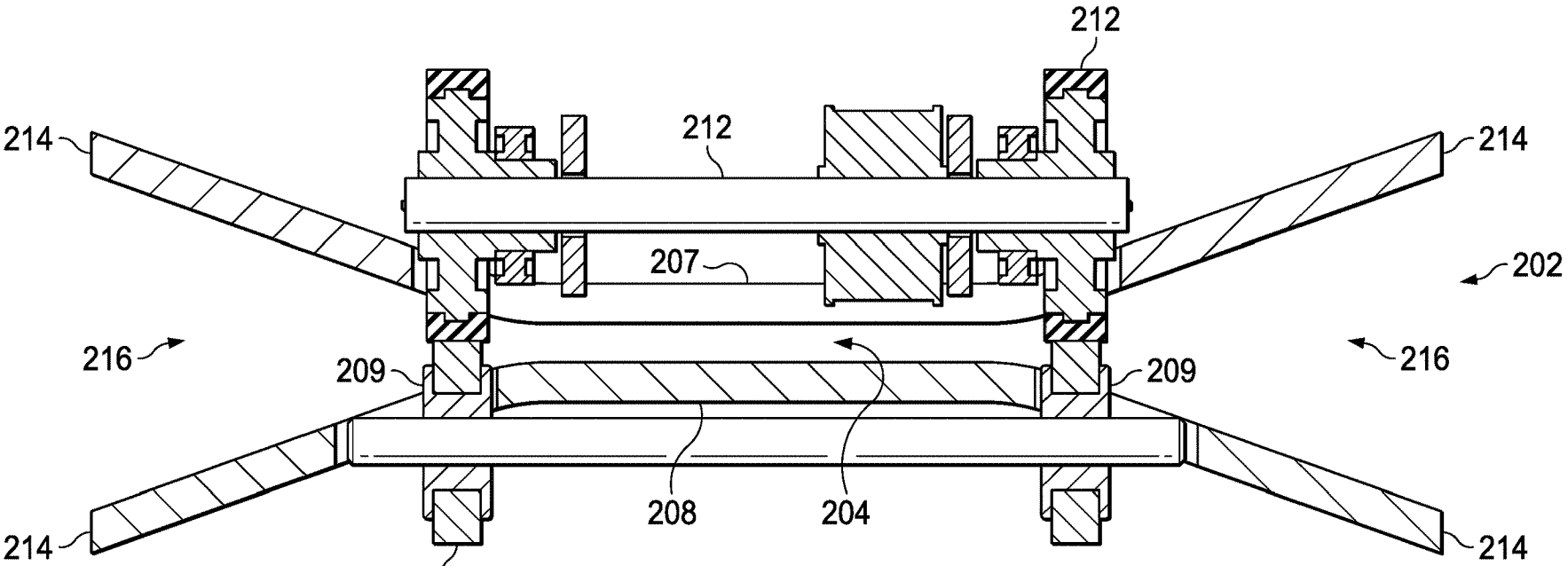
FIG. 2C illustrates a cross sectional view of an open banknote path system in accordance with various embodiments of the present disclosure.

FIGS. 2A-2C illustrate an open banknote path system 200 in accordance with various embodiments of the present disclosure. FIG. 2A illustrates a front perspective view of the open banknote path system 200 in accordance with various embodiments of the present disclosure. FIG. 2B illustrates a cross-sectional view of a banknote path 202 of the open banknote path system 200 showing the general shape of the open banknote path 202 in accordance with various embodiments of the present disclosure. FIG. 2C illustrates a cross-sectional view of the banknote path 202 of the open banknote path system 200 in accordance with various embodiments of the present disclosure. Open banknote path systems in accordance with the present disclosure can come in a wide variety of configurations, and FIGS. 2A-2C do not limit the scope of this disclosure to any particular implementation of an open banknote path system. The open banknote path system 200 can be included in the currency handling apparatus 100 and/or note validator 102.

The open banknote path system includes a chassis or central spine 206 including a first banknote path plate 207 and a second banknote path plate 208 arranged in parallel. Space between the banknote path plates 207, 208 serves as the banknote path 202 for a banknote to pass between the banknote path plates 207, 208. An end of each banknote path plate 207, 208 can be angled to allow a banknote to be deposited into the banknote path 202 via a banknote validator or other banknote feeding mechanism. The banknote path plates 207, 208 turn or curve to direct the banknote through a machine as needed, such as the currency handling apparatus 100. For example, as illustrated in FIG. 2A, the banknote path plates 207, 208 travel from an end where a banknote can be inserted into the banknote path 202 to follow the shape of a frame 210 of a machine, turning at the bottom of the frame 210 to pull the banknote further into the machine. Rollers 212 disposed at intervals along the banknote path plates 207, 208 create pinch points, or drive points 209, between pairs of rollers 212. A roller 212 can include a shaft running between two wheels, where the wheels are disposed on opposite sides of the banknote path 202 and opposite sides of the banknote path plates 207, 208. It will be understood that components such as a motor can be included to rotate the plurality of rollers 212. The rollers 212 rotate such that a banknote can be pulled in by a pair of rollers 212 and squeezed between the wheels of the pair of rollers 212 to pull the banknote along the banknote path 202. A short edge of the banknote can be passed from one pair of rollers 212 to the next pair, from pinch point to pinch point, to pull the banknote through the banknote path 202 and through the machine.

The banknote path 202 is defined by the space between each of the banknote path plates 207, 208. A banknote can be wider than the width of the banknotes path plates 207, 208, and therefore the banknote can also be wider than the banknotes path 202. In banknote paths that are not open, edges of a banknote can come into contact with walls or other objects in the banknote path or in the currency handling apparatus. In some embodiments, of the present disclosure, the ends of the banknote path plates 207, 208 are angled, flared, or otherwise open to create space for the edges of a banknote to travel through the banknote path 202 without the edges of the banknote coming into contact with walls or other objects in the banknote path or in the currency handling apparatus. Each banknote path plate 207, 208 illustrated in FIGS. 2A-2C includes first and second ends 214 extending out and angled away from either side of a central portion 204 of the banknote path 202, creating widening areas in outer portions 216 of the banknote path 202 that are wider than the central portion 204 of the banknote path 202. The angle of the ends 214 can be between greater than 0 degrees and less than 90 degrees in some embodiments. The outer portions 216 are thus open, defining an open banknote path 202 having no walls and not being otherwise enclosed on either side of the banknote path 202. The open sides remove side constraints and open up the banknote path 202 beyond the pinch points of the rollers 212. As illustrated in FIG. 2B, end portions of a banknote 218 can therefore extend out from the central portion 204 of the banknote path 202 beyond the pinch points, and between the ends 214 of the banknote path plates 207, 208. It will be understood that the banknote 218 illustrated in FIG. 2B is used for illustrative purposes, and the banknote can be of different dimensions in relation to the banknote path plates 207, 208. The banknote path plates 207, 208 can also be closer or farther apart than that illustrated, and in turn the relative height of banknote path 202, including the central portion 304 and the outer portions 316, can be different than illustrated without deviating from the present disclosure. In some embodiments, there may be a wall or other surface at the end of the ends 214, with the ends 214 still providing a wider space for the edges of the banknote to travel.

The open ends 214 are more tolerant of folded corners and skewed notes, and can reduce jams or catch points that can sometimes occur due to unfavorable banknote conditions, allowing for higher banknote transport speeds. Even if the edges of the banknote 218 are folded, or if the banknote 218 is skewed in the banknote path 202, the open ends 214 allow room for the banknote to move within the outer portions 216 of the banknote path 202 without contacting walls or other objects in the banknote path or in the currency handling apparatus. In banknote paths that have closed or non-open edges, the long edges of the banknote can drag or curl up due to contact with the sides of the banknote path. The open banknote path system 200 allows for banknotes to travel without contacting the sides of the banknote path 202 even when banknotes are in unfavorable conditions. Since the ends 214 of the open banknote path 202 create a wider path than that of the central portion 204 of the banknote path 202, the long edges of the banknotes do not contact the ends 214. The long edges of the banknotes also do not contact a wall or other object or surface in the machine near the ends 214 of the banknote path 202 since the ends 214 are open. This allows for banknotes to travel through the banknote path 202 without dragging, curling up, or otherwise being slowed down due to banknotes conditions, such as banknote skew or curled edges. The central portion 204 of the banknote path 202 can be narrower than the short edge of the banknote 218, such that the two ends of the short edge of the banknote extend beyond the edges of the spine 206, between the ends 214, and such that the ends of the short edge of the banknote contact the rollers 212. The central portion of the spine 206 or banknote path plates 207, 208 between the ends 214 can also be narrower than that of a banknote receiving path of a banknote validator or other banknote feeding mechanism, such that a banknote fed into the banknote path system 200 via a banknote feeding mechanism contacts the rollers 212 and is pulled along the banknote path 202 of the banknote path system 200.

Figure 3A:
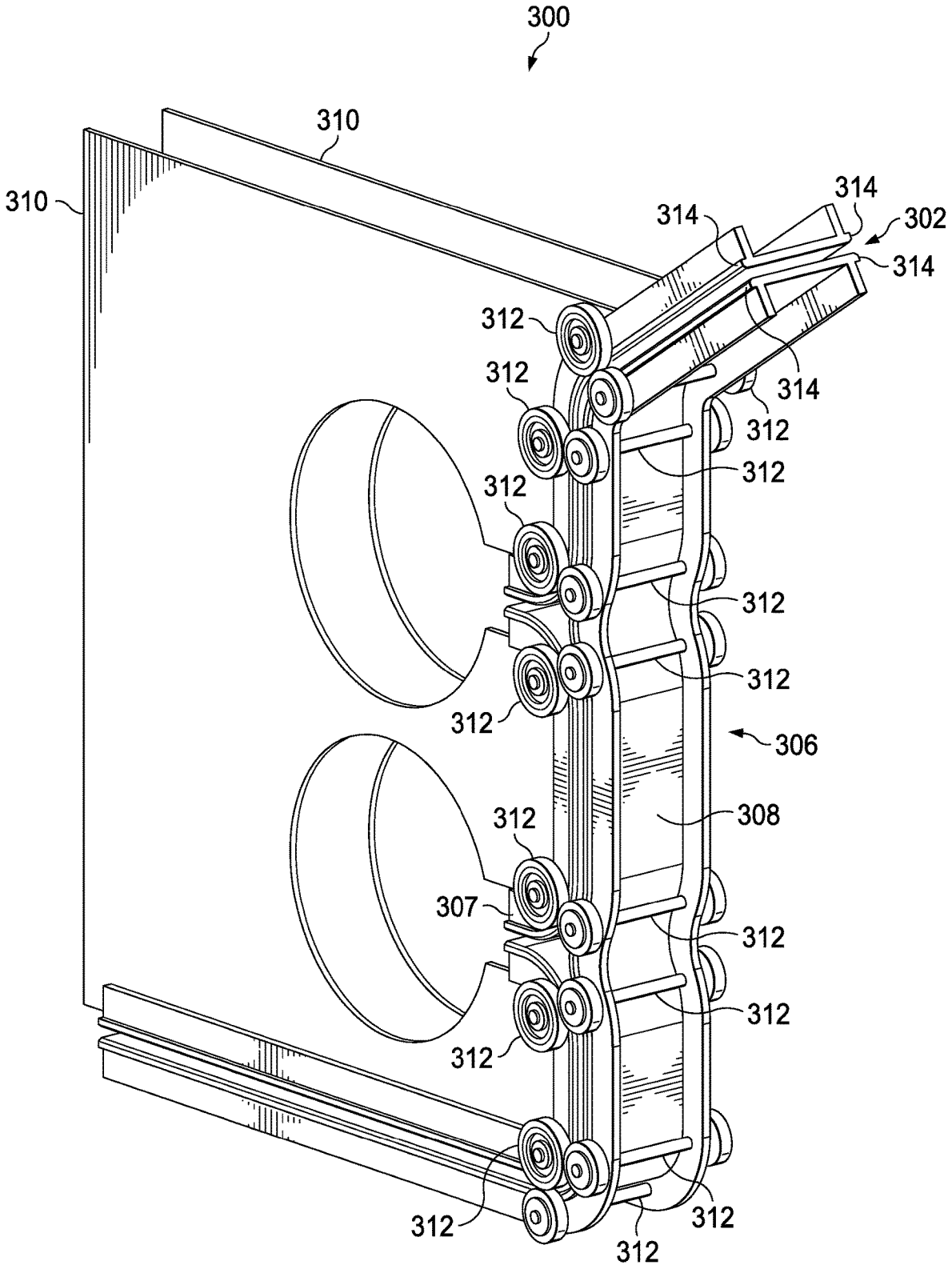
FIG. 3A illustrates a front perspective view of an open banknote path system in accordance with various embodiments of the present disclosure.
Figure 3B:
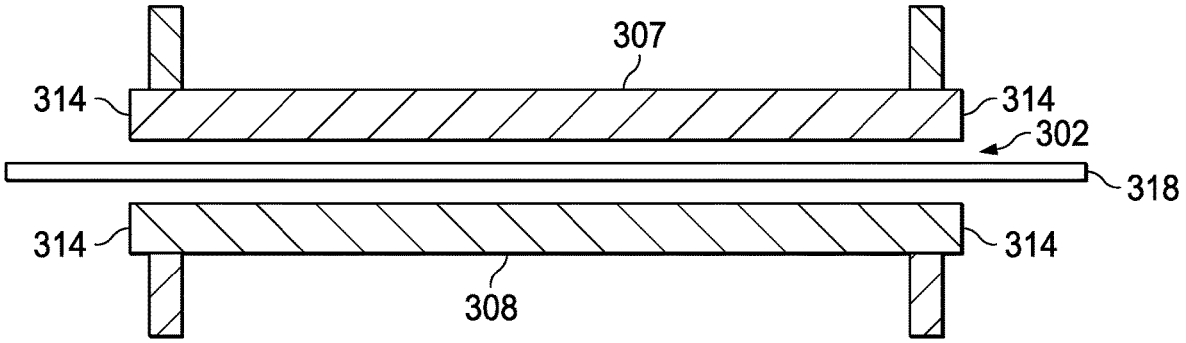
FIG. 3B illustrates a cross-sectional view of a banknote path of an open banknote path system in accordance with various embodiments of the present disclosure.
Figure 3D:
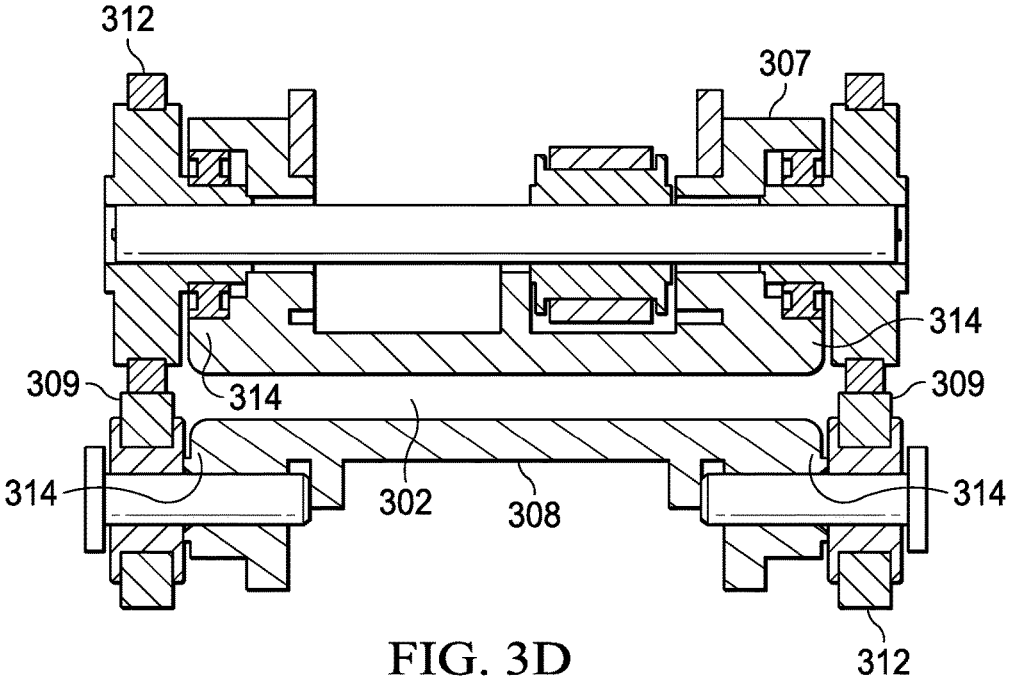
FIG. 3D illustrates a cross sectional view of a banknote path of an open banknote path system in accordance with various embodiments of the present disclosure.
Figure 3C:
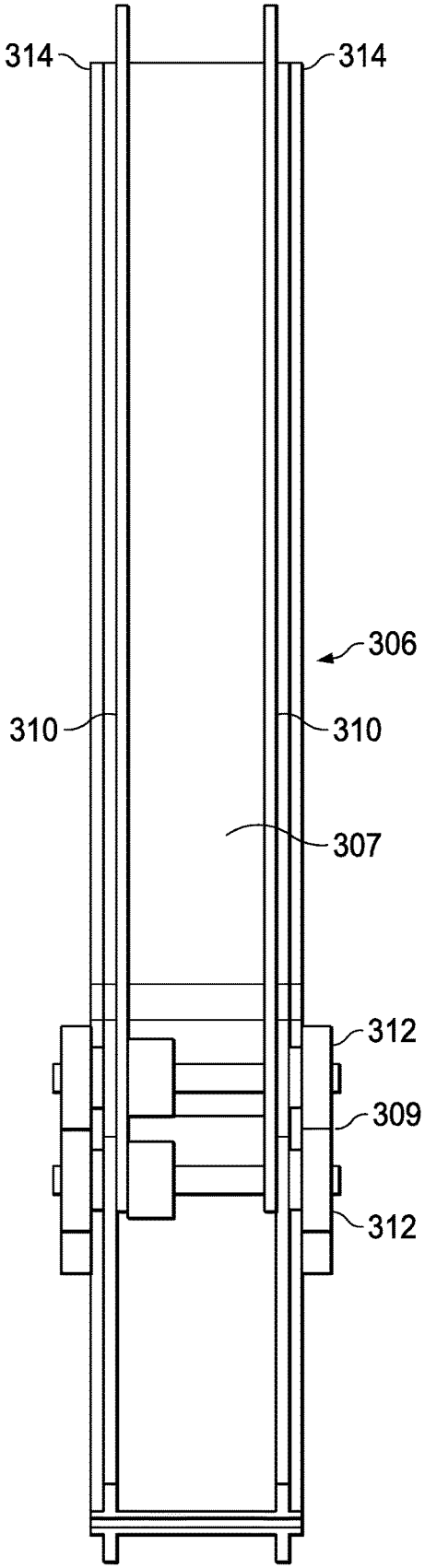
FIG. 3C illustrates a top view of a portion of a spine or chassis of an open banknote path system in accordance with various embodiments of the present disclosure.

FIGS. 3A-3D illustrate an open banknote path system 300 in accordance with various embodiments of the present disclosure. FIG. 3A illustrates a front perspective view of the open banknote path system 300 in accordance with various embodiments of the present disclosure. FIG. 3B illustrates a cross-sectional view of a banknote path of an open banknote path system in accordance with various embodiments of the present disclosure. FIG. 3C illustrates a top view of a portion of a banknote path spine 306 of the open banknote path system 300 in accordance with various embodiments of the present disclosure. FIG. 3D illustrates a cross-sectional view of a banknote path 302 of the open banknote path system 300 in accordance with various embodiments of the present disclosure. Open banknote path systems in accordance with the present disclosure can come in a wide variety of configurations, and FIGS. 3A-3D do not limit the scope of this disclosure to any particular implementation of an open banknote path system. The open banknote path system 300 can be included in the currency handling apparatus 100 and/or note validator 102.

The open banknote path system 300 includes a chassis or central spine 306 including a first banknote path plate 307 and a second banknote path plate 308 arranged in parallel. Space between the banknote path plates 307, 308 serves as a banknote path 302 for a banknote to pass between the banknote path plates 307, 308. An end of each banknote path plate 307, 308 can be angled to allow a banknote to be deposited into the banknote path 302. The banknote path plates 307, 308 turn or curve as to direct the banknote through a machine as needed. For example, in FIG. 3A, the banknote path plates 307, 308 travel from an end where a banknote can be inserted into the banknote path 302 to follow the shape of a frame 310 of a machine, turning at the bottom of the frame 310 to pull the banknote further into the machine. Rollers 312 disposed at intervals along the banknote path plates 307, 308 create pinch points, or drive points 309, between pairs of rollers 312. A roller 312 can include a shaft running between two wheels, where the wheels are disposed on opposite sides of the banknote path 302 and opposite sides of the banknote path plates 307, 308. It will be understood that components such as a motor can be included to rotate the plurality of rollers 312. The rollers 312 rotate such that a banknote can be pulled in by a pair of rollers 312 and squeezed between the wheels of the pair of rollers 312 to pull the banknote along the banknote path 302. A short edge of the banknote can be passed from one pair of rollers 312 to the next pair, from pinch point to pinch point, to pull the banknote through the banknote path 302 and through the machine.

The banknote path 302 is defined by the space between each of the banknote path plates 307, 308. A banknote can be wider than the width of the banknotes path plates 307, 308, and therefore the banknote can also be wider than the banknotes path 302. In banknote paths that are not open, edges of a banknote can come into contact with walls or other objects in the banknote path or in the currency handling apparatus. The ends of the banknote path plates 307, 308 open to create space for the edges of a banknote to travel through the banknote path 202, and allows the edges of the banknote to move within the machine as the banknote is transported, without the edges of the banknote coming into contact with walls or other objects in the banknote path or in the currency handling apparatus. Each banknote path plate 307, 308 illustrated in FIG. 3A-3D includes first and second open ends 314 disposed at a first side and a second side, respectively, of the banknote path 302, opening to a wider area than that of the banknote path 302. The banknote path 302 is disposed in-between the drive points 309 created by each pair of rollers along the banknote path 302, wherein the width of the banknote path is defined by the space between the drive points 309, and the height of the banknote path 302 is defined by the space between the banknote path plates 307, 308. The wheels of the rollers 312 are disposed along an outside edge of the spine 306 near the open ends 314 of the banknote path 302.

The open sides remove side constraints and open up the banknote path 302 beyond the pinch points of the rollers 312. As illustrated in FIG. 3B, end portions of a banknote 318 can extend out from the banknote path 302. It will be understood that the banknote 318 illustrated in FIG. 3B is used for illustrative purposes, and the banknote can be of different dimensions in relation to the banknote path plates 307, 308. The banknote path plates 307, 308 can also be closer or farther apart than that illustrated, and in turn the relative height of banknote path 302 can be different than illustrated without deviating from the present disclosure. Short edges of a banknote thus extend out from each side of the banknote path 302 such that the short edges of the banknote contact the drive points 309 between the rollers 312 so that the banknote is pulled along the banknote path 302 by the rollers 312. As a banknote travels through the banknote path 302 while being pulled through by the rollers 312, the edges of the banknote can extend a distance away from the spine 306, extending beyond the width of the banknote path plates 307, 308, and even beyond the rollers 312. Since the ends 314 of the banknote path 302 are open, the edges of the banknote extending beyond the banknote path 302 and beyond the rollers 312 can avoid contact with any surfaces of the open banknote path system 300 or of a machine in which the open banknote path system 300 is installed. This allows for the banknote to travel through the banknote path 302 without the edges of the banknote dragging or curling upon other surfaces, even when a banknote is skewed or in an otherwise unfavorable condition.

As illustrated in FIG. 3D, the spine 306, and the banknote path plates 307, 308, reside in-between the wheels or drive points 309 of the rollers 312 and allow for the rollers 312 to have short shafts, as the length of the shafts are similar to the width of the spine 306. This provides for better shaft centering, such that the centers of the holes of the wheels do not have to be matched across large spans and multiple parts. The central spine 306 in a fully open banknote path type transport system, such as in the banknote path system 300, also allows for higher force pinch points for better banknote control and drive than other systems such as systems that transport banknotes between flat belts. The banknote path 302 is controlled along the spine 306 and in between the drive points 309 of the rollers 312. Portions of the long edges of a banknote can protrude beyond the drive points 309, but since the banknote path 302 is open beyond the drive points 309, long edges of the banknote are free to move in relation to the banknote path 302 without dragging or otherwise being slowed down by contact with other surfaces. The spine 306 can be narrower than the short edge of a banknote, such that the two ends of the short edge of the banknote extend beyond the edges of the spine 306, and such that the ends of the short edge of the banknote contact the rollers 312. The spine 306 can also be narrower than that of a banknote receiving path of a banknote validator or other banknote feeding mechanism, such that a banknote fed into the banknote path system 300 via a banknote feeding mechanism contacts the rollers 312 and is pulled along the banknote path 302 of the banknote path system 300.

Some banknote path systems are designed from the outermost left and right sides inwards, or can be one sided systems (one side of the banknote path is closed and the other open) providing a cantilevered spine. The banknote path systems described herein provide for a completely open system designed out from the center of the banknote path. Additionally, closed banknote path systems might include gutters at the left and right sides of the banknote path in an attempt to reduce edge catch points and seams. However, an open banknote path as described herein allows for removal of any surfaces of the banknote path on which the banknote can get caught.

Additionally, other open banknote path type systems may use belts running opposed to one another between which a banknote is squeezed and transported through the banknote path. Systems that use belts may use complicated transitions between belt systems and modules, and belt tension has to be carefully controlled. In the open banknote path systems described herein, beltless banknote paths using rollers including pinch points avoid these problems, as a pair of rollers may be placed along the banknote path where needed instead of having to also provide for a complicated path for belts.

One example embodiment can include an open banknote path system, the system comprising a first banknote path plate and a second banknote path plate coupled to a frame, wherein the first banknote path plate and the second banknote path plate are disposed a distance apart, a banknote path disposed in a space between the first banknote path plate and the second banknote path plate, wherein each of a first side and a second side of the banknote path open to an area wider than a central portion of the banknote path, and a plurality of rollers each coupled to one of the first banknote path plate and the second banknote path plate, wherein each one of the plurality of rollers forms a banknote pinch point with another one of the plurality of rollers.

In one or more of the above examples, the first banknote path plate is disposed parallel to the second banknote path plate.

In one or more of the above examples, the first banknote path plate and the second banknote path plate each include a first angled end and a second angled end, wherein the first and second angled ends extend obliquely from the center portion of the banknote path.

In one or more of the above examples, the banknote path includes outer portions adjacent to each side of the central portion, wherein each outer portion is defined by a space disposed between the first angled ends of the first and second banknote path plates or the second angled ends of the first and second banknote path plates, and wherein each of the outer portions includes an area wider than the central portion of the banknote path.

In one or more of the above examples, the pinch points are operable to allow left and right side edges of a banknote to protrude from the pinch points and into the outer portions of the banknote path.

In one or more of the above examples, each one of the plurality of rollers includes a shaft disposed between a first wheel and a second wheel.

In one or more of the above examples, the first wheel and the second wheel of each of the plurality of rollers are disposed external to a width of the first and second banknote path plates.

In one or more of the above examples, each pinch point is arranged in a series along the first and second banknote path plates.

In one or more of the above examples, the plurality of rollers are operable to receive a banknote and to pass the banknote from one pinch point to the next pinch point in the series.

In one or more of the above examples, the pinch points are operable to allow left and right side edges of a banknote to protrude from the pinch points and into an open area of the open banknote path system.

Another example embodiment can include a currency handling apparatus, comprising a chassis, a banknote validator coupled to the chassis, a first banknote path plate and a second banknote path plate coupled to the chassis, wherein the first banknote path plate and the second banknote path plate are disposed a distance apart, a banknote path disposed in a space between the first banknote path plate and the second banknote path plate, wherein each of a first side and a second side of the banknote path open to an area wider than a central portion of the banknote path, and a plurality of rollers each coupled to one of the first banknote path plate and the second banknote path plate, wherein each one of the plurality of rollers forms a banknote pinch point with another one of the plurality of rollers.

In one or more of the above examples, the first banknote path plate is disposed parallel to the second banknote path plate.

In one or more of the above examples, the first banknote path plate and the second banknote path plate each include a first angled end and a second angled end, wherein the first and second angled ends extend obliquely from the center portion of the banknote path.

In one or more of the above examples, the banknote path includes outer portions adjacent to each side of the central portion, wherein each outer portion is defined by a space disposed between the first angled ends of the first and second banknote path plates or the second angled ends of the first and second banknote path plates, and wherein each of the outer portions includes an area wider than the central portion of the banknote path.

In one or more of the above examples, the pinch points are operable to allow left and right side edges of a banknote to protrude from the pinch points and into the outer portions of the banknote path.

In one or more of the above examples, each one of the plurality of rollers includes a shaft disposed between a first wheel and a second wheel.

In one or more of the above examples, the first wheel and the second wheel of each of the plurality of rollers are disposed external to a width of the first and second banknote path plates.

In one or more of the above examples, each pinch point is arranged in a series along the first and second banknote path plates.

In one or more of the above examples, the plurality of rollers are operable to receive a banknote and to pass the banknote from one pinch point to the next pinch point in the series.

In one or more of the above examples, the pinch points are operable to allow left and right side edges of a banknote to protrude from the pinch points and into an open area of the currency handling apparatus.

In one or more of the above examples, the currency handling apparatus further comprises a banknote recycler and a removable storage unit.

One example embodiment can include a currency handling apparatus, comprising a banknote path configured to transport banknotes, the banknote path including an inlet, at least one set of rollers, a center area in which at least a portion of a banknote is transported, at least one side area disposed adjacent the center area, and wherein the at least one side area of the banknote path includes a larger area than the center area of the banknote path. This example embodiment can include or incorporate any of the above examples.

One example embodiment can include a banknote path comprising an inlet, at least one set of rollers configured to pull a banknote through the banknote path, and an upper plate and a lower plate, wherein a distance between the upper plate and the lower plate at a first point is greater than a distance between the upper plate and the lower plate at a second point. This example embodiment can include or incorporate any of the above examples.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An open banknote path system, the system comprising:

a first banknote path plate and a second banknote path plate coupled to a frame, wherein the first banknote path plate and the second banknote path plate are disposed a distance apart;

a banknote path disposed in a space between the first banknote path plate and the second banknote path plate, wherein a first side of a width of the banknote path and a second side of the width of the banknote path each open to an area wider than a central portion of the banknote path, wherein the width of the banknote path is perpendicular to a banknote travel direction; and a plurality of rollers each coupled to one of the first banknote path plate and the second banknote path plate, wherein each one of the plurality of rollers forms a pinch point with another one of the plurality of rollers.

2. The system of claim 1, wherein the first banknote path plate is disposed parallel to the second banknote path plate.

3. The system of claim 2, wherein the first banknote path plate and the second banknote path plate each include a first angled end and a second angled end, wherein each of the first angled end and the second angled end of each of the first banknote path plate and the second banknote path plate extend obliquely from the central portion of the banknote path.

4. The system of claim 3, wherein the banknote path includes outer portions adjacent to each side of the central portion, wherein each of the outer portions is defined by a space disposed between the first angled end of the first banknote path plate and the first angled end of the second banknote path plate, or between the second angled end of the first banknote path plate and the second angled end of the second banknote path plate, and wherein each of the outer portions includes the area wider than the central portion of the banknote path.

5. The system of claim 1, wherein each pinch point is operable to allow left and right side edges of a banknote to protrude from each pinch point and into the area wider than the central portion of the banknote path.

6. The system of claim 1, wherein each one of the plurality of rollers includes a shaft disposed between a first wheel and a second wheel.

7. The system of claim 6, wherein the first wheel and the second wheel of each of the plurality of rollers are disposed external to a width of the first banknote path plate and the second banknote path plate.

8. The system of claim 1, wherein each pinch point is arranged in a series along the first banknote path plate and the second banknote path plate.

9. The system of claim 8, wherein the plurality of rollers are operable to receive a banknote and to pass the banknote from one pinch point to a next pinch point in the series.

10. The system of claim 9, wherein each pinch point is operable to allow left and right side edges of the banknote to protrude from each pinch point and into an open area of the open banknote path system.

11. A currency handling apparatus, comprising:

a chassis;

a banknote validator coupled to the chassis;

a first banknote path plate and a second banknote path plate each coupled to the chassis, wherein the first banknote path plate and the second banknote path plate are disposed a distance apart;

a banknote path disposed in a space between the first banknote path plate and the second banknote path plate, wherein a first side of a width of the banknote path and a second side of the width of the banknote path each open to an area wider than a central portion of the banknote path, wherein the width of the banknote path is perpendicular to a banknote travel direction; and a plurality of rollers each coupled to one of the first banknote path plate and the second banknote path plate, wherein each one of the plurality of rollers forms a banknote pinch point with another one of the plurality of rollers.

12. The apparatus of claim 11, wherein the first banknote path plate is disposed parallel to the second banknote path plate.

13. The apparatus of claim 12, wherein the first banknote path plate and the second banknote path plate each include a first angled end and a second angled end, wherein each of the first angled end and the second angled end of each of the first banknote path plate and the second banknote path plate extend obliquely from the central portion of the banknote path.

14. The apparatus of claim 13, wherein the banknote path includes outer portions adjacent to each side of the central portion, wherein each of the outer portions is defined by a space disposed between the first angled end of the first banknote path plate and the first angled end of the second banknote path plate, or between the second angled end of the first banknote path plate and the second angled end of the second banknote path plate, and wherein each of the outer portions includes the area wider than the central portion of the banknote path.

15. The apparatus of claim 11, wherein each pinch point is operable to allow left and right side edges of a banknote to protrude from each pinch point and into the area wider than the central portion of the banknote path.

16. The apparatus of claim 11, wherein each one of the plurality of rollers includes a shaft disposed between a first wheel and a second wheel.

17. The apparatus of claim 16, wherein the first wheel and the second wheel of each of the plurality of rollers are disposed external to a width of the first banknote path plate and the second banknote path plate.

18. The apparatus of claim 11, wherein each pinch point is arranged in a series along the first banknote path plate and the second banknote path plate.

19. The apparatus of claim 18, wherein the plurality of rollers are operable to receive a banknote and to pass the banknote from one pinch point to a next pinch point in the series.

20. The apparatus of claim 19, wherein each pinch point is operable to allow left and right side edges of the banknote to protrude from each pinch point and into an open area of the currency handling apparatus.

21. A currency handling apparatus, comprising:

a banknote path configured to transport banknotes, the banknote path including:

an inlet;

at least one set of rollers;

a center area in which at least a portion of a banknote is transported;

at least one side area disposed adjacent the center area; and wherein the at least one side area of a width of the banknote path includes a larger area than the center area of the banknote path, wherein the width of the banknote path is perpendicular to a banknote travel direction.

22. A banknote path comprising:

an inlet;

at least one set of rollers configured to pull a banknote through the banknote path; and an upper plate and a lower plate, wherein a distance between the upper plate and the lower plate at a first point along a width of the banknote path is greater than a distance between the upper plate and the lower plate at a second point along the width of the banknote path, wherein the width of the banknote path is perpendicular to a banknote travel direction.

* * * * *